US007271540B2

(12) United States Patent
Kim et al.

(10) Patent No.: US 7,271,540 B2
(45) Date of Patent: Sep. 18, 2007

(54) PLASMA DISPLAY PANEL WITH BUS ELECTRODES HAVING LIGHT-ABSORBING PORTION AND METHOD FOR FORMING THE SAME

(75) Inventors: Joon-Hyeong Kim, Cheonan-si (KR); Tae-Woong Jang, Cheonan-si (KR); Eun-Gi Heo, Cheonan-si (KR)

(73) Assignee: Samsung SDI Co., Ltd., Suwon (KR)

( * ) Notice: Subject to any disclaimer, the term of this patent is extended or adjusted under 35 U.S.C. 154(b) by 187 days.

(21) Appl. No.: 10/989,641

(22) Filed: Nov. 17, 2004

(65) Prior Publication Data

US 2005/0151474 A1 Jul. 14, 2005

(30) Foreign Application Priority Data

Nov. 18, 2003 (KR) ..... 10-2003-0081744

(51) Int. Cl.
*H01J 17/49* (2006.01)

(52) U.S. Cl. ..... 313/587; 582/584; 582/585

(58) Field of Classification Search ..... 345/37, 345/41, 60, 71; 315/169.4; 313/582–587, 313/82

See application file for complete search history.

(56) References Cited

U.S. PATENT DOCUMENTS

2003/0141816 A1* 7/2003 Lim ..... 313/586

FOREIGN PATENT DOCUMENTS

| | | | |
|---|---|---|---|
| JP | 2002-008546 | A1 | 11/2002 |
| JP | 2003-249172 | A1 | 5/2003 |
| KR | 10-2003-0023404 | A | 3/2003 |

OTHER PUBLICATIONS

Machine translation of JP 2003-249172, Kojima Hideki and Iguchi Yuichiro, Sep. 5, 2003.*

* cited by examiner

*Primary Examiner*—Joseph Williams
*Assistant Examiner*—Bumsuk Won
(74) *Attorney, Agent, or Firm*—H.C. Park & Associates, PLC

(57) ABSTRACT

A plasma display panel (PDP) can include a front panel with a plurality of scan electrodes and a plurality of common electrodes and a rear panel with a plurality of installed barrier walls. In such a PDP, a plurality of first bus electrodes and a plurality of second bus electrodes may be formed on one surface of a front substrate of the front panel. The first bus electrodes may be formed in contact with one surface of the front substrate, and at least portions of the scan electrodes and common electrodes may be formed between the first bus electrodes and the second bus electrodes. Also, the first bus electrodes may include a conductive material that absorbs light from the other surface of the front substrate.

18 Claims, 3 Drawing Sheets

PLASMA DISPLAY PANEL WITH BUS ELECTRODES HAVING LIGHT-ABSORBING PORTION AND METHOD FOR FORMING THE SAME

CROSS-REFERENCE TO RELATED APPLICATION

This application claims the priority of Korean Patent Application No. 2003-81744, filed on Nov. 18, 2003, which is incorporated herein by reference in its entirety.

BACKGROUND OF THE INVENTION (a) Field of the Invention

The present invention relates to technology of driving a panel such as a plasma display panel (PDP), and more particularly, to a PDP including first bus electrodes and second bus electrodes.

(b) Description of the Related Art

A plasma display panel (PDP) is a device for displaying characters or graphics using light emitted from plasma that is induced during gas discharge. There are direct current (DC) type and an alternating current (AC) type PDPs. They are categorized depending on what kind of applied voltage they use. Depending on the electrode structure of discharge cells, AC type PDPs can be categorized as facing surface discharging type, surface discharging type, or barrier wall discharging type. In a surface discharging type PDP, electrodes for inducing a discharge are disposed on one substrate and a fluorescent substance is disposed on another substrate, thereby reducing deterioration of the fluorescent substance due to ion bombardment during discharge. For this reason, surface discharging type PDPs have been widely used in recent years.

A typical structure of a PDP, for example, an AC surface discharging type PDP, will be described. A PDP includes a front substrate and a rear substrate. A plurality of scan electrodes and a plurality of common electrodes can be disposed on the front substrate, and bus electrodes can be respectively disposed on a surface of the scan electrodes and common electrodes. A front dielectric layer can be formed to cover the electrodes disposed on the front substrate, and a protective layer can be formed using, for example, MgO to cover the front dielectric layer. A plurality of address electrodes can be disposed on the rear substrate, and a rear dielectric layer can be formed on the rear substrate to cover the address electrodes. A plurality of barrier walls can be placed on the rear dielectric layer, and red, green, and blue phosphors can be coated between the barrier walls.

This AC surface discharging type PDP can be driven using charges formed on the dielectric layers covering the electrodes, i.e., wall charges. Address discharge can be induced in discharge spaces between the scan electrodes or the common electrodes (which are disposed in parallel on the front substrate) and the address electrodes (which face the scan electrodes and common electrodes), thereby forming surface discharge.

The bus electrodes are typically formed of Ag paste. However, the bus electrodes formed of Ag paste may detract from the luminance of the PDP by absorbing visible rays emitted from a phosphor layer formed on a rear panel and also increase luminance of reflected light. To solve these problems, the bus electrodes are sometimes replaced by double bus electrodes including, for example, black bus electrodes and white bus electrodes. An example of the double bus electrodes is disclosed in Korean Patent Laidopen Publication No. 2003-0023404. In this disclosure, some bus electrodes, which contact scan electrodes and common electrodes, are formed of black bus electrodes, and the other bus electrodes facing phosphor layers are formed of white bus electrodes. The black bus electrodes are formed of, for example, Au paste including a large amount of black pigment, so that they cannot only function as conductive bus electrodes but also effectively absorb light to reduce luminance of reflected light without using black stripes. Also, the white bus electrodes reflect visible rays emitted during gas discharge such that the black bus electrodes do not absorb them, thereby improving luminance of the PDP.

However, this PDP having the foregoing double bus electrodes involves structural problems. To be specific, since the black bus electrodes directly contact the scan electrodes and common electrodes, contact resistance between the scan/common electrodes and the black bus electrodes becomes high, thus resulting in a luminance step difference. The luminance step difference refers to a luminance difference between a region where white discharge and sustain discharge occur and a region where white discharge occurs but sustain discharge does not occur (e.g., a region adjacent to a dark portion). This luminance step difference is one of the factors affecting the quality of a screen: peak luminance, white uniformity, and contrast ratio, for example. As the luminance step difference between regions increases, it is easier for a user to recognize a difference in screen quality.

Experiments 1 and 2 show that a luminance step difference results from black bus electrodes. Experiment 1 shows case 1-1 where the bus electrodes included black bus electrodes and white bus electrodes and case 1-2 where bus electrodes included only white bus electrodes. In both cases 1-1 and 1-2, resistances and luminance step differences were measured and compared. Experiment 2 shows cases 2-1 and 2-2 where bus electrodes included black bus electrodes and white electrodes. However, while case 2-1 used white bus electrodes having high resistance, case 2-2 used white bus electrodes having low resistance. Similarly, in both cases 2-1 and 2-2, resistances and luminance step differences were measured and compared.

Experiment 1

| | Case 1-1 | Case 1-2 |
|---|---|---|
| Resistance | 89 | 63 |
| Luminance step difference(Max) ($cd/m^2$) | 6 | 3 |

Experiment 2

| | Case 2-1 | Case 2-2 |
|---|---|---|
| Resistance | 93 | 64 |
| Luminance step difference(Max) ($cd/m^2$) | 21 | 20 |

As shown in the above Tables, in Experiment 1 the maximum luminance step difference in case 1-1 was twice the maximum luminance step difference in case 1-2. However, in Experiment 2, maximum luminance step differences in both cases 2-1 and 2-2 were similar. Therefore, it is clear that the poor conductive characteristic of the black bus electrodes in contact with the scan and common electrodes causes a luminance step difference, thereby deteriorating the quality of the screen.

SUMMARY OF THE INVENTION

The present invention provides, for example, a plasma display panel (PDP), which prevents degradation of contrast due to light and improves luminance. The present invention also provides, for example, a PDP that has a structure that simplifies the process for forming bus electrodes.

The present invention provides, for example, a plasma display panel (PDP) including a front panel and a rear panel in which a plurality of barrier walls are installed. The front panel may include a plurality of scan electrodes and a plurality of common electrodes. A plurality of first bus electrodes and a plurality of second bus electrodes may be formed on one surface of a front substrate of the front panel. The first bus electrodes may be formed in contact with one surface of the front substrate. At least portions of one of the scan electrodes and common electrodes may be formed between the first bus electrodes and the second bus electrodes. Also, the first bus electrodes may contain a light-absorbing material and a conductive material.

The first bus electrodes may be formed of, for example, Cr, $CrO_x$, or $RuO_2$. The conductive material constituting the first bus electrodes may be Ag, and the first bus electrodes may further contain a black pigment.

The width of each of the second bus electrodes may be smaller than the width of each of the first bus electrodes. Only portions of the first bus electrodes may be in contact with the scan electrodes or the common electrodes, and the remaining portions of the first bus electrodes may be in contact with the second bus electrodes.

Each of the first bus electrodes may be about 300 to about 1000 Å thick. Each of the first bus electrodes may be about 500 Å or less thick.

An etched portion may be formed on one surface of the front substrate, and at least portions of the first bus electrodes may be buried in the etched portion.

The first bus electrodes may be formed of Ag and a black pigment. Each of the first bus electrodes may be about 0.5 to about 5 μm thick. The second bus electrodes may be narrower than the first bus electrodes.

The present invention also provides, for example, a method of forming a PDP including a front panel and a rear panel. The method may include forming a plurality of first bus electrodes on one surface of a front substrate of the front panel using a light-absorbing material and a conductive material. It may also include forming a plurality of scan electrodes and common electrodes, at least one of which being in contact with at least portions of the first bus electrodes. It may further include forming second bus electrodes in contact with the at least one of the scan electrodes and common electrodes.

The method may further include forming a plurality of etched portions in one surface of the front substrate to bury the first bus electrodes before forming the first bus electrodes.

In the PDP, the first bus electrodes (which may be black bus electrodes) may be formed on one surface of the front substrate. The scan electrode and the common electrode may be formed between the second bus electrodes (which may be white bus electrodes). If the first bus electrodes are directly in contact with the second bus electrodes, contact resistance may be reduced, thereby improving the luminance step difference. Also, the first bus electrodes may be formed between the front substrate and the scan/common electrodes. As a result, degradation of contrast due to light can be prevented and luminance of the PDP can improve.

In addition, the etched portion may be formed in one surface of the front substrate, and at least portions of the first bus electrodes may be buried in the etched portion. Accordingly, the obviation of any additional process, such as a planarization, may simplify the manufacture of the PDP, thus remarkably reducing the manufacturing cost.

Further, the present invention may save money by manufacturing the PDP using simplified and economical processes.

DETAILED DESCRIPTION OF THE INVENTION

Figure 1:
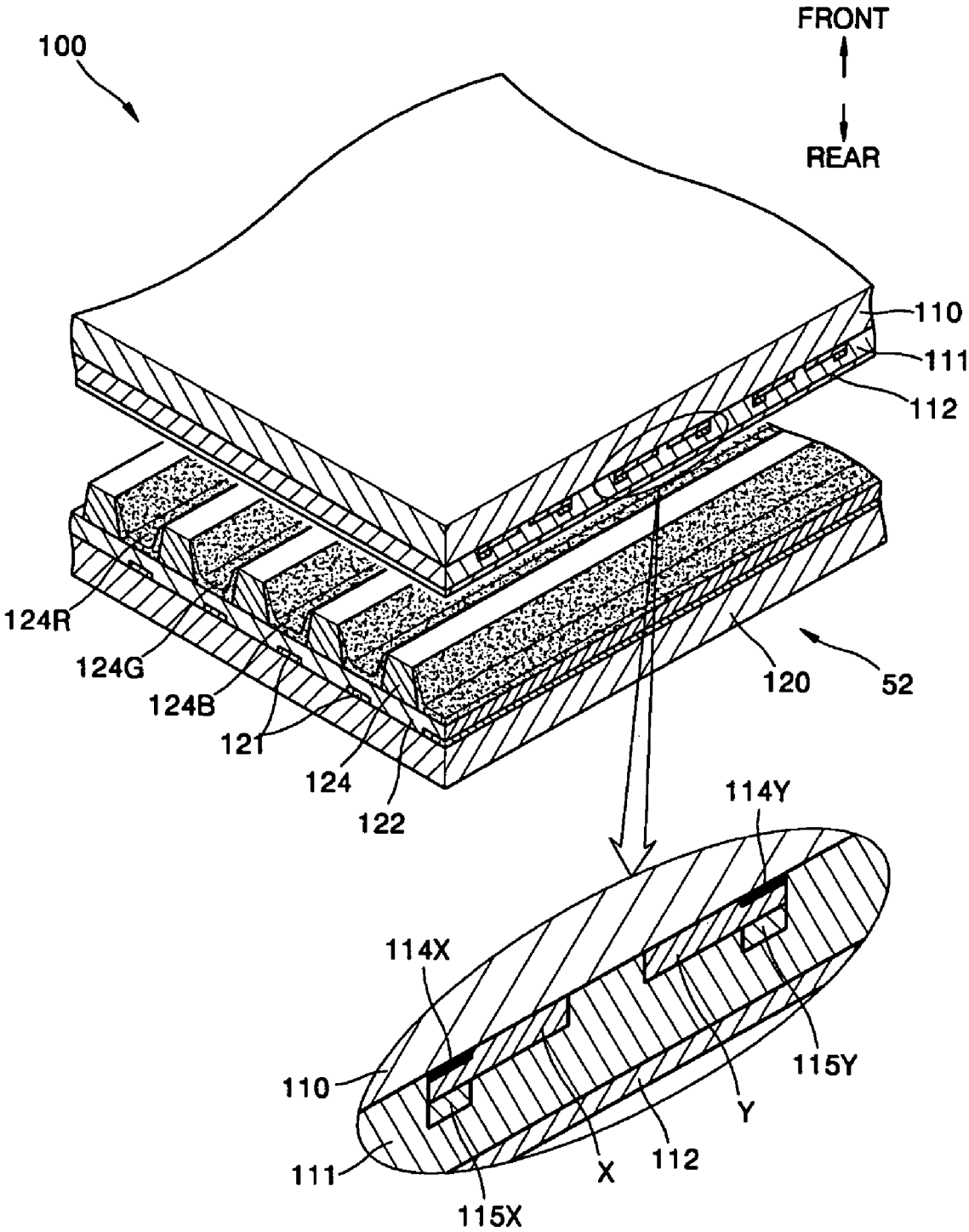
FIG. 1 is an internal cross-sectional view and an exploded view of a plasma display panel (PDP) according to an embodiment of the present invention.
Figure 2A:
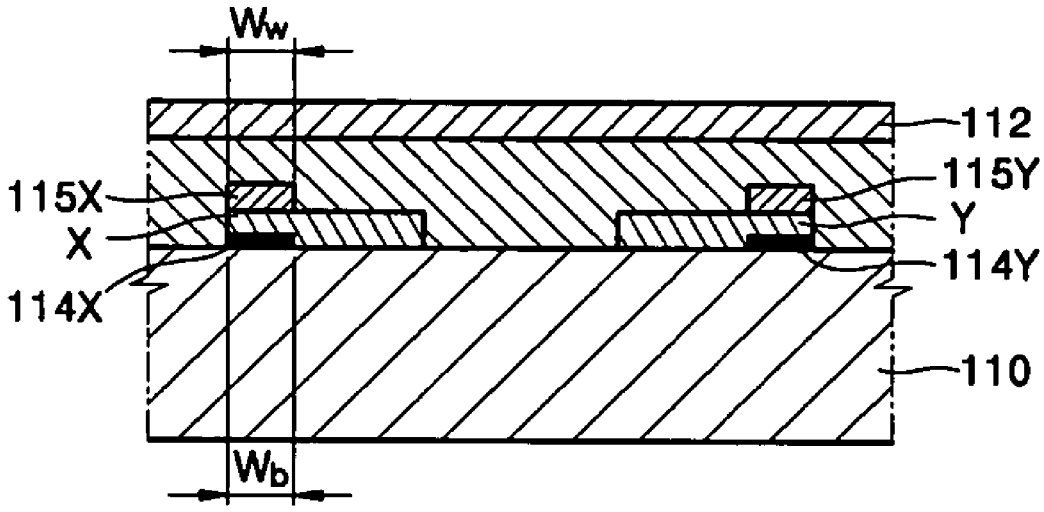
FIG. 2A is an exploded cross-sectional view of the PDP shown in FIG. 1.

As shown in FIGS. 1 and 2A, a plasma display panel (PDP) 100 may include a rear panel 52 including a rear substrate 120, address electrodes 121 arranged on the rear substrate 120, a rear dielectric layer 122 covering the address electrodes 121, and barrier walls 124 arranged parallel with the address electrodes 121. A plurality of first bus electrodes 114X and 114Y may be formed on one surface of the front substrate 110. After the first bus electrodes 114X and 114Y are formed in contact with one surface of the front substrate 110, a scan electrode X and a common electrode Y may be formed such that at least a portion of the scan electrode X and at least a portion of the common electrode Y are in contact with the first bus electrodes 114X and 114Y, respectively. Generally, to prevent the blocking of visible rays emitted from phosphor layers 124R, 124G, and 124B, the scan electrode X and the common electrode Y may be formed of a material such as indium tin oxide (ITO) that satisfies the necessary technical requirements (such as high transmissivity, low resistivity, good thickness uniformity, close contact with bus electrodes, and high heat-resistance).

After the scan electrode X and the common electrode Y are formed, second bus electrodes 115X and 115Y may be formed on the other surfaces of the scan electrode X and the common electrode Y that are in contact with the first bus electrodes 114X and 114Y. This may be done such that the second bus electrodes 115X and 115Y are in contact with portions of the scan electrode X and the common electrode Y. Thus, at least portions of the scan electrode X and the common electrode Y are disposed between the first bus electrode 114X and 114Y and the second bus electrodes 115X and 115Y. The first bus electrodes 114X and 114Y may be formed of a conductive material that absorbs light so that the first bus electrodes 114X and 114Y not only function as bus electrodes but also absorb light from the other surface of the front substrate 110.

The first bus electrodes 114X and 114Y may be formed of various conductive materials, such as Cr, CrOx, and $RuO_2$, or of a material such as Ag containing a black pigment.

The second bus electrodes 115X and 115Y formed of Ag may reflect visible rays from the phosphor layers 124R, 124G, and 124B to increase luminance of the PDP. The width $W_w$ of the second bus electrodes 115X and 115Y can be relatively small and the width $W_b$ of the first bus electrodes 114X and 114Y can be relatively great in order to reduce discoloration of Ag during a sinter process and improve the contrast of the POP. That is, the width $W_w$ of the second bus electrodes 115X and 115Y can be less than the width $W_b$ of the first bus electrodes 114X and 114Y.

A front dielectric layer 111 may be arranged to cover the first bus electrodes 114X and 114Y, the scan electrode X and common electrode Y, and the second bus electrodes 115X and 115Y, and a protective layer 112 may be arranged to cover the first dielectric layer 111. The protective layer 112 may be, for example, MgO.

Figure 2B:
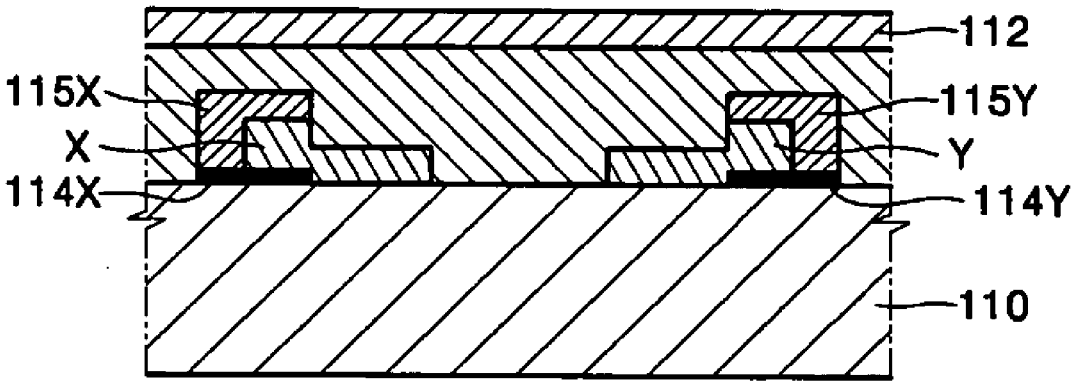
FIGS. 2B and 2C are cross-sectional views of PDPs according to additional embodiments of the present invention.

As shown in FIG. 2B, only portions of first bus electrodes 114X and 114Y may contact a scan electrode X and a common electrode Y, respectively, and the remaining portions thereof may contact second bus electrodes 115X and 115Y, respectively. In this case, the contrast of the PDP can improve due to the extending widths of the first bus electrodes 114X and 114Y. Also, the extending portions of the second bus electrodes 115X and 115Y, which are in contact with the first bus electrodes 114X and 114Y, respectively, may allow effective reflection of visible rays from phosphor layers 124R, 124G, and 124B.

The first bus electrodes 114X and 114Y can be formed thin. The scan electrode X and the common electrode Y can be formed contacting at least portions of the first bus electrodes 114X and 114Y. When they are thus formed, the time taken to form the scan electrode X and the common electrode Y to more than the thickness of the first bus electrodes 114X and 114Y can be reduced. Also, if the first bus electrodes 114X and 114Y are formed to the small thickness after a layer for forming the scan electrode X and the common electrode Y is formed and patterned, any additional process (for example planarization) can be omitted. As a result, the first bus electrodes 114X and 114Y can be formed to a thickness of about 300 to 1000 Å. Although the first bus electrodes 114X and 114Y are preferably as thin as possible, they may be formed about 500 521 thick or less to facilitate manufacture thereof.

Figure 2C:
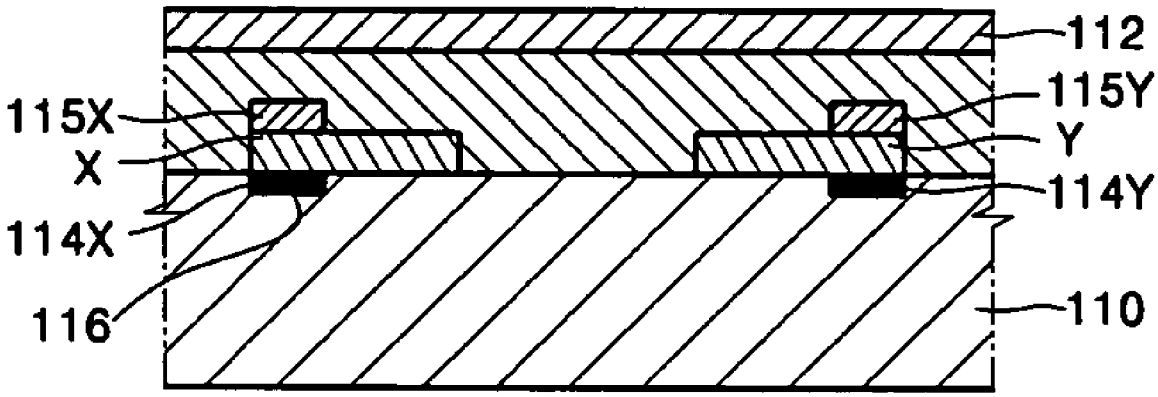

As shown in FIG. 2C, before first bus electrodes 114X and 114Y are formed, an etched portion 116 may be additionally formed in one surface of a front substrate 110. For example, after the etched portion 116 is formed in one surface of the front substrate 110, a bus electrode layer may be formed on the entire surface of the etched portion 116. It may then be patterned using a photolithography process or a pattern print method, and then sintered. Thus, the first bus electrodes 114X and 114Y may be formed. Thereafter, a scan electrode X and a common electrode Y may be formed. That is, at least portions of the first bus electrodes 114X and 114Y can be buried in the etched portion 116 formed in one surface of the front substrate 110 so as to flatten the surface during formation of the first bus electrodes 114X and 114Y. Thus, the scan electrode X and the common electrode Y can be uniformly formed without any additional process (for example, planarization). The etched portion 116 may be formed using various methods such as, for example, sand blasting or etching.

Also, the etched portion 116 should be formed to an appropriate depth in consideration of process requirements for forming the etched portion 116 and the functional specification of the first bus electrodes 114X and 114Y. That is, the etched portion 116 may be formed to a thickness of about 0.5 to about 5 μm. To reduce the discoloration of second electrodes 115X and 115Y (which contact the scan electrode X and the common electrode Y) and to improve the contrast of the PDP, the second bus electrodes 115X and 115Y can be formed narrower than the first bus electrodes 114X and 114Y.

The PDP of the present invention having one of the above-described structures can have the following effects.

In the PDP, the first bus electrodes (which may be black bus electrodes) are formed on one surface of the front substrate, and the scan electrode and the common electrode are formed between the second bus electrodes (which may be white bus electrodes). As the first bus electrodes are directly in contact with the second bus electrodes, contact resistance may be reduced to improve the luminance step difference. Also, the first bus electrodes may be formed between the front substrate and the scan/common electrodes. As a result, degradation of contrast due to light can be prevented and luminance of the PDP can improve.

In addition, the etched portion may be formed in one surface of the front substrate, and at least some portion of the first bus electrodes may be buried in the etched portion. Accordingly, since any additional process (for example, planarization) is unnecessary, the manufacture of the PDP may be simplified. This may remarkably reduce the manufacturing cost. Further, the present invention may permit the manufacture of the PDP using simplified and economical processes.

While the present invention has been particularly shown and described with reference to exemplary embodiments thereof, various changes in form and details may be made without departing from the scope of the present invention.

What is claimed is:

1. A plasma display panel, comprising:

a front panel including a plurality of scan electrodes and a plurality of common electrodes; and a rear panel including a plurality of installed barrier walls, wherein a plurality of first bus electrodes and a plurality of second bus electrodes are formed on a first surface of a front substrate of the front panel, the first bus electrodes are formed in contact with the first surface of the front substrate, and at least portions of one of the scan electrodes and common electrodes are formed between the first bus electrodes and the second bus electrodes, wherein the first bus electrodes are conductive electrodes comprising a light-absorbing material and a conductive material, and wherein only select portions of the first bus electrodes are in contact with the scan electrodes or the common electrodes, and substantially the remaining portions of the first bus electrodes are in contact with the second bus electrodes.

2. The panel of claim 1, wherein the first bus electrodes comprise at least one material selected from the group of Cr, $CrO_x$, and $RuO_2$.

3. The panel of claim 1, wherein the conductive material of the first bus electrodes is Ag, and the first bus electrodes further contain a black pigment.

4. The panel of claim 1, wherein each of the second bus electrodes is narrower than each of the first bus electrodes.

5. The panel of claim 1, wherein each of the first bus electrodes is between about 300 to about 1000 Å thick.

6. The panel of claim 1, wherein each of the first bus electrodes is about 500 Å thick or less.

7. The panel of claim 1, wherein an etched portion is formed on one surface of the front substrate, and at least portions of the first bus electrodes are buried in the etched portion.

8. The panel of claim 7, wherein the first bus electrodes comprise Ag and a black pigment, and each of the first bus electrodes is between about 0.5 to about 5 μm thick.

9. The panel of claim 7, wherein each of the second bus electrodes is narrower than each of the first bus electrodes.

10. A method of forming a plasma display panel including a front panel and a rear panel, comprising:

forming a plurality of conductive first bus electrodes on a first surface of a front substrate of the front panel using a light-absorbing material and a conductive material;

forming a plurality of scan electrodes and common electrodes, at least one of which being in contact with at least portions of the first bus electrodes;

forming second bus electrodes in contact with the at least one of the scan electrodes and common and electrodes; and forming only select portions of the first bus electrodes in contact with the scan electrodes or the common electrodes, and forming substantially the remaining portions of the first bus electrodes in contact with the second bus electrodes.

11. The method of claim 10, further comprising forming a plurality of etched portions in the first surface of the front substrate to bury the first bus electrodes before forming the first bus electrodes.

12. The method of claim 10, further comprising forming the first bus electrodes of at least one material selected from the group of Cr, $CrO_x$, and $RuO_2$.

13. The method of claim 10, wherein the conductive material of the first bus electrodes is Ag, and the first bus electrodes further contain a black pigment.

14. The method of claim 10, wherein each of the second bus electrodes is narrower than each of the first bus electrodes.

15. The method of claim 10, further comprising forming each of the first bus electrodes between about 300 to about 1000 Å thick.

16. The method of claim 10, further comprising forming each of the first bus electrodes about 500 Å thick or less.

17. The method of claim 10, further comprising etching a first portion on one surface of the front substrate, and burying at least portions of the first bus electrodes in the first portion.

18. The method of claim 17, wherein the first bus electrodes comprise Ag and a black pigment, and each of the first bus electrodes is between about 0.5 to about 5 μm thick.

* * * * *